US007307604B2

(12) United States Patent
Miyagawa et al.

(10) Patent No.: US 7,307,604 B2
(45) Date of Patent: Dec. 11, 2007

(54) SEMICONDUCTOR DEVICE, LIGHT-EMITTING DISPLAY DEVICE AND DRIVING METHOD THEREOF

(75) Inventors: Keisuke Miyagawa, Kanagawa (JP); Ryota Fukumoto, Kanagawa (JP)

(73) Assignee: Semiconductor Energy Laboratory Co., Ltd., Atsugi-shi (JP)

( * ) Notice: Subject to any disclaimer, the term of this patent is extended or adjusted under 35 U.S.C. 154(b) by 573 days.

(21) Appl. No.: 10/744,066

(22) Filed: Dec. 24, 2003

(65) Prior Publication Data

US 2004/0252084 A1 Dec. 16, 2004

(30) Foreign Application Priority Data

Dec. 27, 2002 (JP) ..... 2002-378896

(51) Int. Cl.
*G09G 3/00* (2006.01)

(52) U.S. Cl. ..... 345/76; 345/77; 315/169.3

(58) Field of Classification Search ..... 345/76–100
See application file for complete search history.

(56) References Cited

U.S. PATENT DOCUMENTS

| | | | | |
|---|---|---|---|---|
| 5,748,165 | A | 5/1998 | Kubota et al. | |
| 6,091,203 | A | 7/2000 | Kawashima et al. | |
| 6,229,506 | B1 | 5/2001 | Dawson et al. | |
| 6,556,176 | B1 * | 4/2003 | Okuyama et al. | 345/76 |
| 2003/0128200 | A1 | 7/2003 | Yumoto | |
| 2003/0164685 | A1 | 9/2003 | Inukai | |
| 2004/0041752 | A1 | 3/2004 | Kimura | |

FOREIGN PATENT DOCUMENTS

| | | |
|---|---|---|
| EP | 1 333 422 | 8/2003 |
| JP | 07-261151 | 10/1995 |
| JP | 08-137443 | 5/1996 |
| JP | 11-282419 | 10/1999 |
| JP | 2001-083923 | 3/2001 |
| JP | 2002/514320 | 5/2002 |
| WO | WO98/48403 | 10/1998 |
| WO | WO 01/06484 A1 | 1/2001 |
| WO | WO 02/39420 A1 | 5/2002 |

OTHER PUBLICATIONS

International Search Report (Application No. PCT/JP03/16357), Mar. 30, 2004, partial translation, 4 pages.
International Preliminary Examination Report (Application No. PCT/JP03/16357), May 11, 2004, partial translation, 5 pages.

* cited by examiner

*Primary Examiner*—Duc Q. Dinh
(74) *Attorney, Agent, or Firm*—Fish & Richardson P.C.

(57) ABSTRACT

A latch circuit is disposed to an output terminal of the respective stages of a shift register circuit, when a pulse is shifted to a stage to which an output is wanted to be outputted, a latch pulse is inputted and held there until a subsequent pulse is inputted, when the pulse is shifted to a stage to which an output is wanted to be outputted in the next time, a latch pulse is again inputted, and thereby an output stage is switched. Thus, a period to be selected and a stage to be selected can be arbitrary selected by changing a latch pulse without changing a clock frequency.

32 Claims, 14 Drawing Sheets

SEMICONDUCTOR DEVICE, LIGHT-EMITTING DISPLAY DEVICE AND DRIVING METHOD THEREOF

TECHNICAL FIELD

The present invention relates to active matrix type semiconductor devices and light-emitting display devices that are used as a flat display and use thin film transistors (TFT), and a driving method thereof.

BACKGROUND ART

In recent years, a technology of forming a thin film transistor (hereinafter referred to as "TFT") on a substrate has been largely forwarded, and applications to active matrix display devices are in progress. In particular, since a TFT that uses a polysilicon film is higher in the field effect mobility (also called as "mobility") than that that uses an existing amorphous silicon film, a high-speed operation can be realized. Accordingly, pixel control that is so far driven with a driving circuit outside of a substrate is enabled to carry out with a driving circuit formed on the substrate same as that of the pixel.

In such an active matrix display device, since various circuits and elements can be formed on the same substrate, various kinds of advantages such as reduction of manufacturing cost, miniaturization of a display device, an increase in manufacturing yield and a decrease in throughput can be obtained.

Furthermore, a study of an active matrix type EL display device that has an electroluminescent element (EL element) as a self-emitting element is actively forwarded.

In general, a current value that is flowed to an EL element and brightness of the EL element are in proportion. Accordingly, a pixel configuration that is different from that of a LCD in which the brightness is controlled through a voltage value, in particular, a pixel configuration that controls the brightness through a current value is proposed (patent document 1).

Furthermore, at the same time, in order to control the brightness through the current value, devises are necessary not only for the pixel but also for the driving circuit. Accordingly, various driving circuit configurations have been proposed (patent document 2).

An example of the driving circuits, as shown in FIG. 9A, is constituted of a shift transistor part constituted of DFFs, a NAND circuit, and a buffer circuit constituted of inverters. A general example of a timing chart of the driving circuit is shown in FIG. 9B. In this circuit configuration, a pulse shifts in accordance with a CLK synchronization signal.

(Patent document 1)

WO 01/06484 pamphlet (Patent document 2)

WO 02/39420 pamphlet

DISCLOSURE OF THE INVENTION (Problems that the Invention is to Solve)

So far, in a configuration in which a current source circuit is disposed to each of pixels to control brightness through a current value, by outputting a pulse from outside of the pixel to the current source circuit, a timing that sets a current value so as to be able to output always a constant current is determined. Start and final timings of the setting are determined by an output pulse width of a driving circuit. At that time, a time necessary for setting is generally longer than a clock cycle of the driving circuit.

However, in the existing method, without varying a clock frequency an output pulse width cannot be arbitrarily varied, and an output stage cannot be arbitrarily selected every several stages.

As a method to overcome the problems, a method that uses a decoder can be considered. In the case of a decoder being used, an arbitrary output stage can be selected and the pulse width can be freely varied through an external signal.

However, in the case of the decoder being used, as a number of stages wanted to be outputted increases, a number of signals inputted from an external circuit increases, a number of input terminals increases, and at the same time load on the external circuit increases. Furthermore, a circuit itself that constitutes a decoder becomes, as a number of stages increases, complicated and large.

In view of these situations, the present invention intends to provide a driving circuit that can arbitrarily alter an output pulse width, can arbitrarily select a row every several stages, and is simple in circuit configuration and low in burden on an external circuit.

(Means for Solving the Problems)

A latch circuit is disposed to an output terminal of the respective stages of a shift register circuit that sequentially shifts a pulse, when a pulse is shifted to a stage to which an output is wanted to be outputted, a latch pulse is inputted and held there until a subsequent pulse is inputted, when the pulse is shifted to a stage to which an output is wanted to be outputted in the next time, a latch pulse is again inputted, and thereby an output stage is switched. Thus, when a latch circuit is disposed in a driving circuit and a circuit (hereinafter referred to as "latch pulse generation circuit") that outputs a latch pulse at an arbitrary timing is disposed, a driving circuit that can arbitrarily alter an output pulse width and can arbitrarily select a row every several stages can be provided.

The present invention intends to provide a semiconductor device and a light-emitting display device, characterized in that in a driver circuit that includes a shift register circuit having register circuits, a latch circuit array having latch circuits and a latch pulse generation circuit that generates a latch pulse that drives the latch circuit, a start pulse is inputted in the shift register circuit, the start pulse sequentially shifts the register circuit in accordance with a clock signal, and in the latch circuit an output of a pulse from the corresponding register circuit is inputted.

The invention intends to provide a method of driving a semiconductor device and a light-emitting display device, characterized in that in a semiconductor device and a light-emitting display device that include a shift register circuit having register circuits, a latch circuit array having latch circuits and a circuit that generates a latch pulse that drives the latch circuit, a start pulse is inputted in the shift register circuit, the start pulse is sequentially shifted to the register circuit based on a clock signal, a pulse outputted from the register circuit and a latch pulse outputted from the circuit that generates a latch pulse are inputted in the latch circuit, and the latch circuit outputs the pulse to a current source circuit based on an input of the latch pulse.

In the invention, the latch pulse generation circuit may be on a substrate different from that on which the shift register circuit and the latch circuit array are or may be on the same substrate therewith.

Furthermore, in the above invention, the latch pulse generation circuit may generate a latch pulse from the start pulse and the clock pulse.

Still furthermore, in the above invention, the latch pulse generation circuit may be characterized by including a first shift register circuit that includes a first register circuit that shifts in synchronization with the start pulse and a second shift register circuit that includes a second register circuit that shifts in synchronization with the clock signal.

Furthermore, in the above invention, each of output terminals of a plurality of the latch circuits may be connected to one or a plurality of control terminals of current source circuits.

Still furthermore, in the above invention, the current source circuit may be within a driving circuit that controls a current value that is inputted in a pixel.

Furthermore, in the above invention, the current source circuit may be in a plurality of pixels arranged in matrix.

(Advantage of the Invention)

When a semiconductor device according to the present invention is used, a display device that can, without varying a clock frequency, easily vary a pulse width of an output of a driver, obtain a time sufficient for memorizing a current value in a retention capacitor of the current source circuit, and realize high quality display can be provided.

BEST MODE FOR CARRYING OUT THE INVENTION

In what follows, embodiments of the present invention will be explained with reference to the drawings.

Embodiment 1

Figure 1:
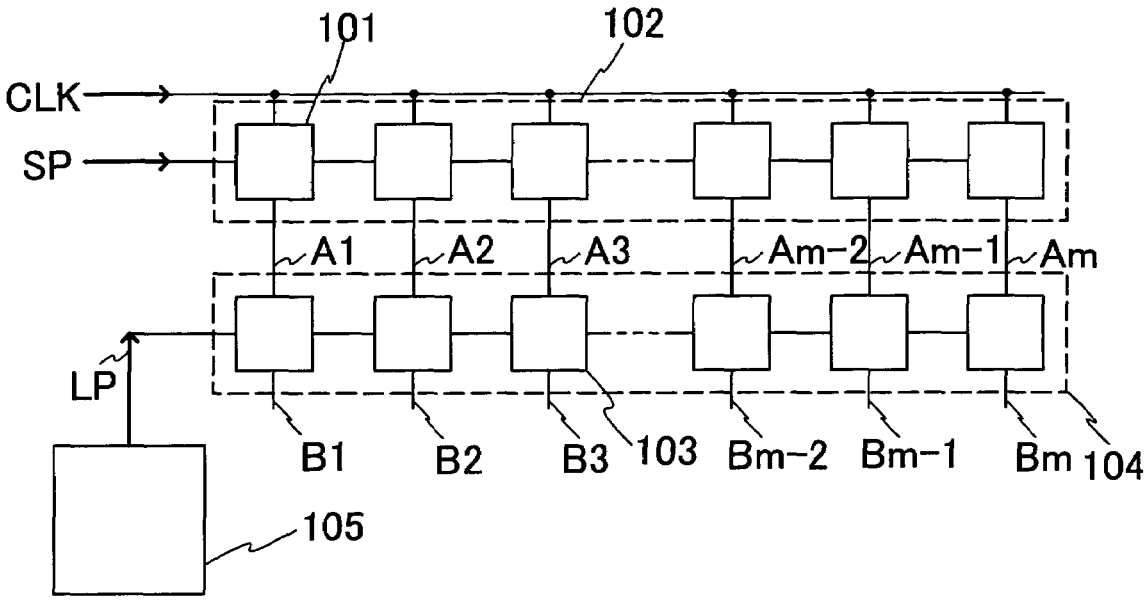
FIG. 1 is a diagram showing a circuit configuration of a semiconductor device according to embodiment 1 of the present invention.

FIG. 1 is a diagram showing embodiment 1 according to the invention. The embodiment 1 includes a shift register circuit 102 that is constituted of register circuits 101, a latch circuit array 104 that is configured of latch circuits 103, and a latch pulse generation circuit 105. The latch pulse generation circuit 105 may be formed on a substrate same as that on which the shift register circuit 102 and the latch circuit array 104 are formed or may be formed on a substrate different therefrom.

Figure 2:
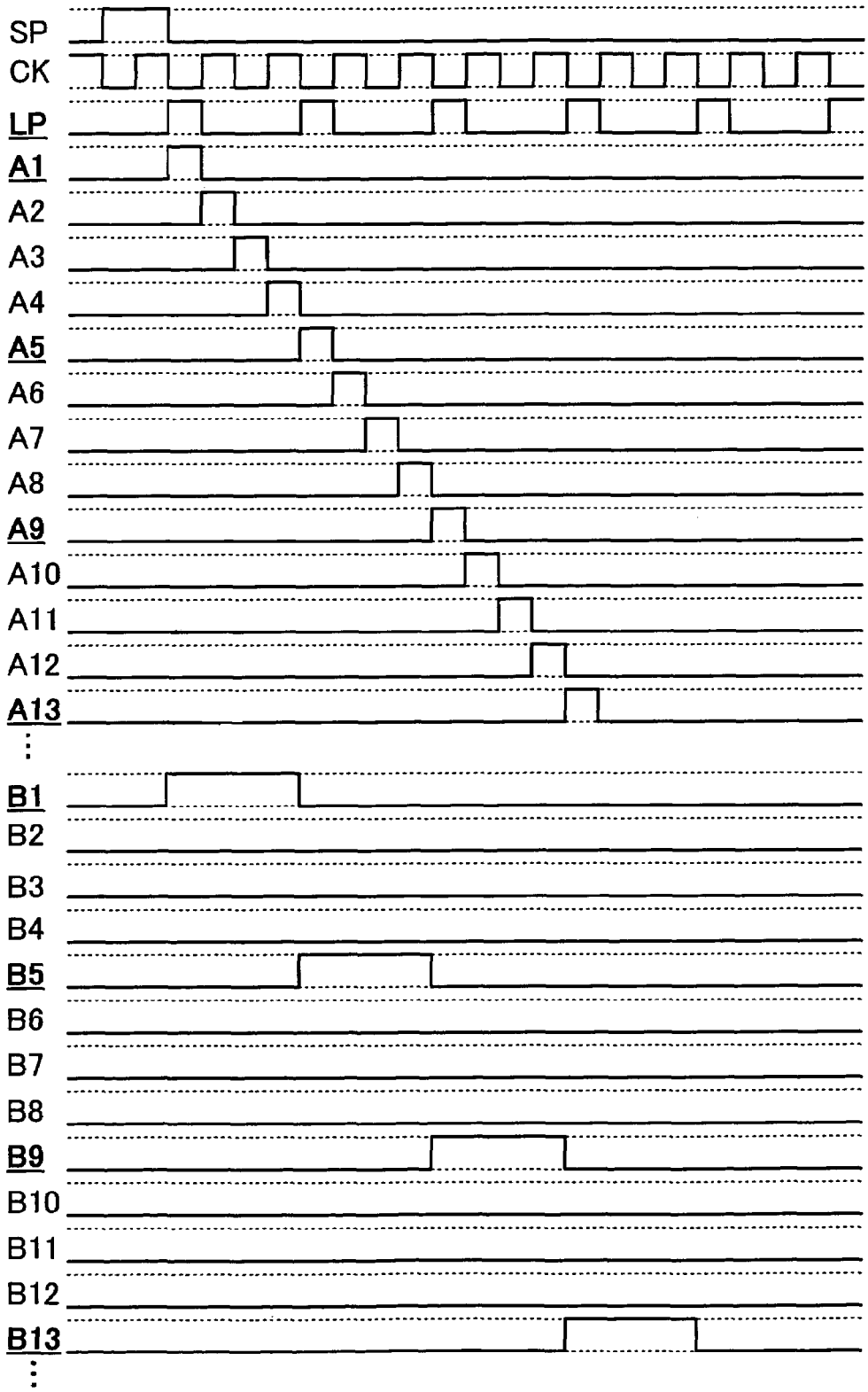
FIG. 2 is a diagram showing a timing chart according to embodiment 1 of the invention.
Figure 3:
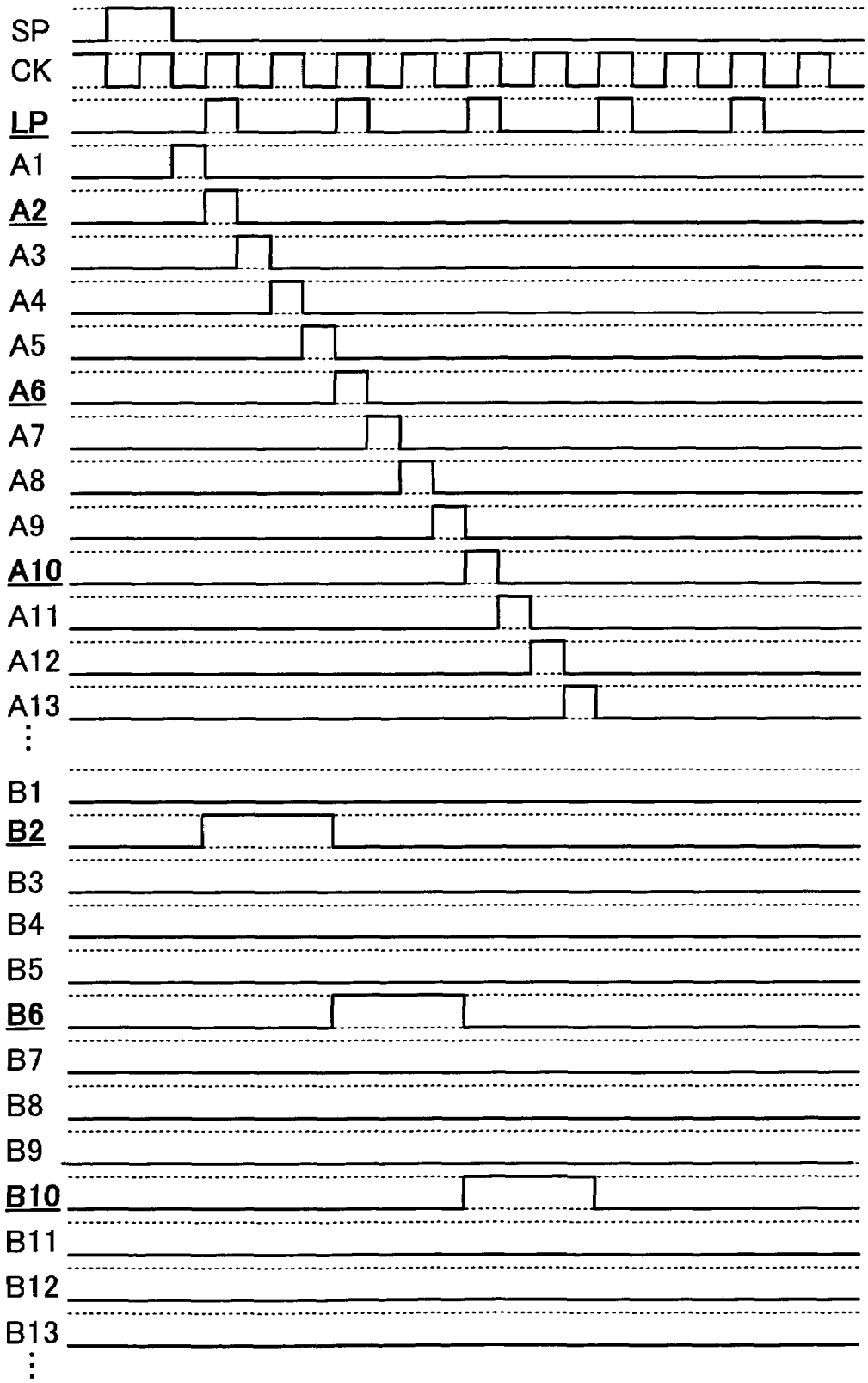
FIG. 3 is a diagram showing a timing chart according to embodiment 1 of the invention.

FIGS. 2 and 3 each show an example of a timing chart according to the embodiment. When a start pulse signal SP and a clock signal CK are inputted in a shift register circuit, the shift register circuit shifts a pulse in synchronization with the clock signal. When a latch pulse signal LP is inputted in accordance with an output timing of the shift register circuit, an output level of the shift register circuit when the latch pulse signal LP is at an H level is latched, and, until the latch pulse signal LP becomes an H level in the next time, a state thereof is retained.

For instance, when latch pulse signals LP are inputted at timings of FIG. 2, at a first latch timing, A1 is latched at an H level, in all of other stages an L level is latched, and until a next latch timing this state is retained and outputted. At a second latch timing, A5 is latched at an H level, in all of other stages an L level is latched, and similarly until a next latch timing this state is retained. In FIG. 2, 1st, 5th, 9th and 13th stages each sequentially output a pulse, and a pulse width is four times an output width of the shift register.

FIG. 3 shows an operation when a timing of a latch pulse signal is different from that of FIG. 2. In this case, 2nd, 6th and 10th stages each sequentially output a pulse, and a pulse width is similarly four times an output width of the shift register.

Thus, when a timing of the latch pulse LP is devised, an outputting stage can be arbitrarily selected, and furthermore a pulse width can be arbitrarily varied.

Embodiment 2

Figure 4:
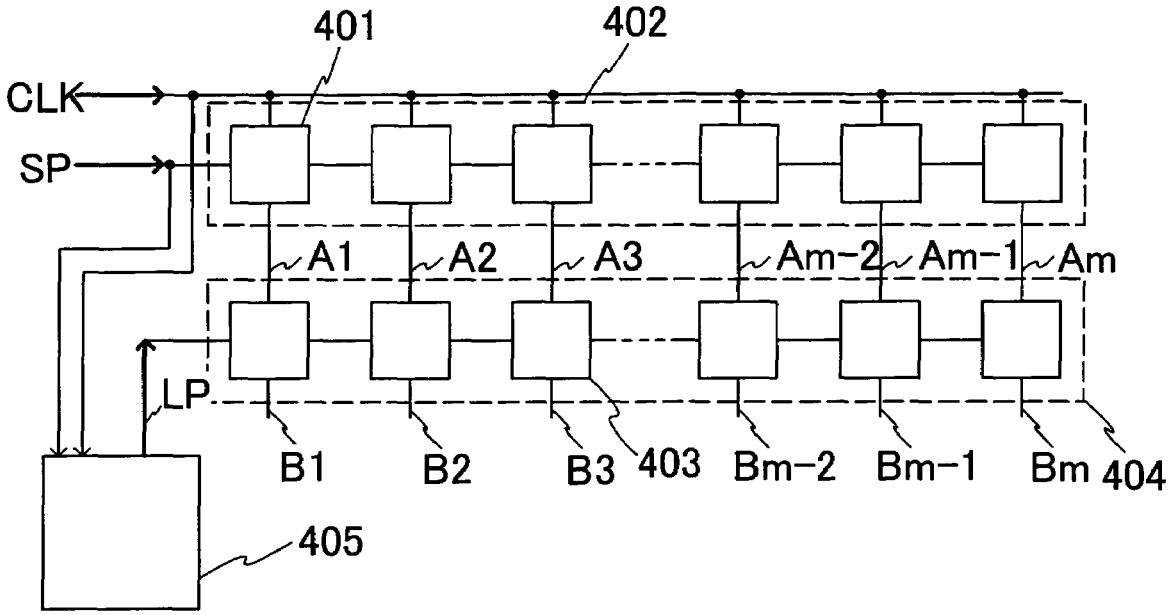
FIG. 4 is a diagram showing a circuit configuration of a semiconductor device according to embodiment 2 of the present invention.

FIG. 4 is a diagram showing embodiment 2 according to the invention. The embodiment 2 includes a shift register circuit 402 that is constituted of register circuits 401, a latch circuit array 404 that is configured of latch circuits 403, and a latch pulse generation circuit 405. The latch pulse generation circuit 405 may be formed on a substrate same as that on which the shift register circuit 402 and the latch circuit array 405 are formed or may be formed on a substrate different therefrom. In FIG. 4, a start pulse signal SP and a clock signal CLK are inputted and the latch pulse generation circuit outputs a latch pulse LP.

Operations of the shift register circuit and latch array circuit are identical as that of embodiment 1; accordingly, explanations will be omitted.

Figure 5A:
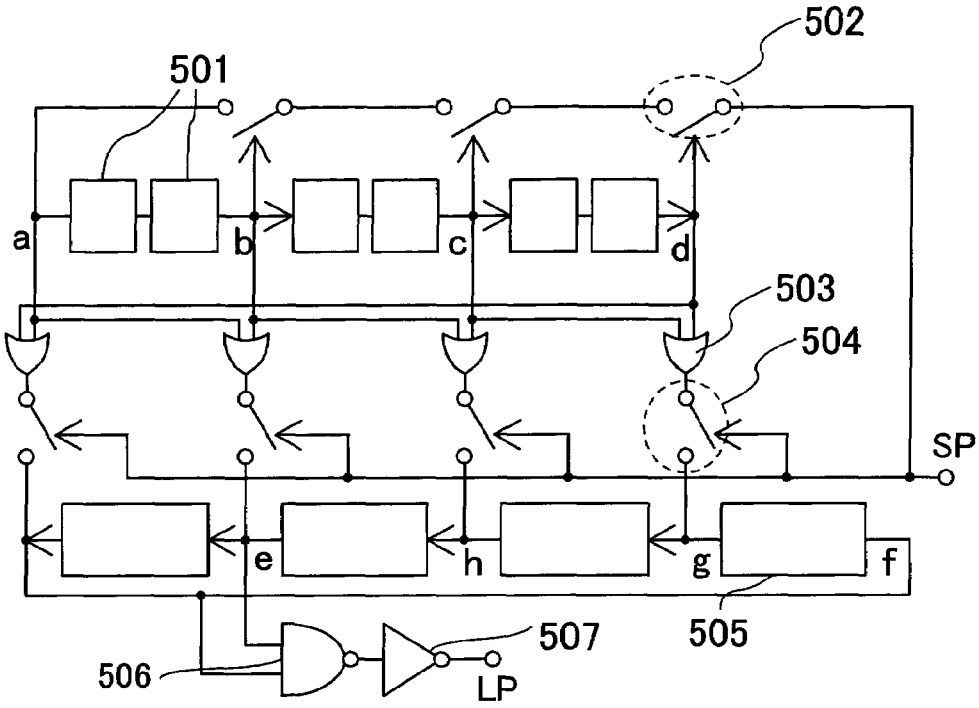
FIGS. 5A and 5B include a diagram showing a circuit configuration of a semiconductor device and a diagram showing a timing chart according to embodiment 2 of the invention.

FIG. 5A is an example of latch pulse generation circuits in embodiment 2. The latch pulse generation circuit includes first register circuits 501, first switches 502, OR circuits 503, second switches 504, second register circuits 505, a NAND circuit 506 and an inverter 507.

The first register circuits shift a pulse with the start pulse signal SP as a synchronization signal, and second register circuits shift a pulse with the clock signal CLK as a synchronization signal. Furthermore, the first switches are turned on when a control signal is an L level and turned off when it is an H level. On the contrary, the second switches are turned on when the control signal is an H level, and turned off when it is an L level.

Still furthermore, an interval during which a latch pulse signal is outputted is determined in accordance with a number of stages of the second register circuit. When the first register circuit has m stages and the second register circuit has n stages, there is relationship of m=2(n−1). FIG. 5A is a diagram showing, as an example, a case of m=6 and n=4. The first register circuit, after taking in a start pulse signal SP at a node a, repeats the state n times with the start pulse signal SP as a synchronization signal. At a timing when the state is nth, the first switches 502 all are turned on to take in a start pulse signal SP, and thereby the state is reset as a first one. Furthermore, every times when the start pulse signal SP becomes an H level, the state of the first register circuit is transmitted to the second register circuit. The second register circuit repeats the state n times with the clock signal CLK as a synchronization signal, and, in a certain state, here in a state where nodes e and f are an H level, outputs a latch pulse signal.

Figure 5B:
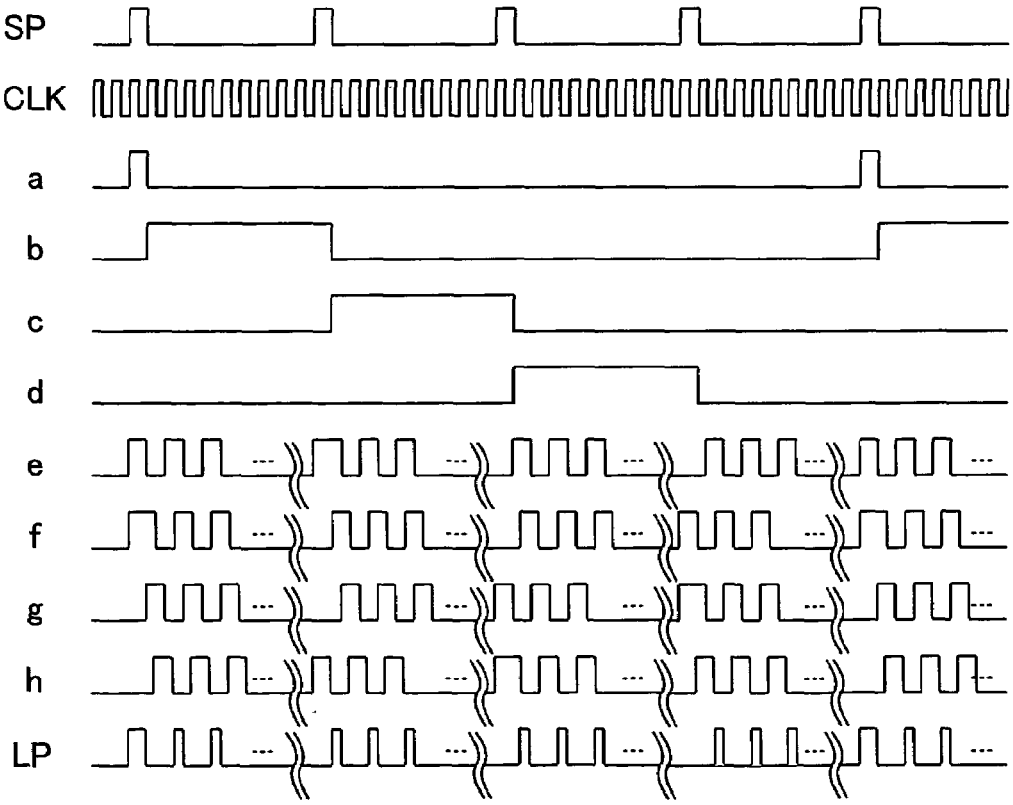

A timing chart of operations of a latch pulse generation circuit of FIG. 5A is shown in FIG. 5B. In a configuration of FIG. 5A, when a half cycle of a clock signal CLK is counted as one count, a latch pulse signal is outputted every four counts. Furthermore, the timing when the latch pulse signal is outputted shifts one count every times when the start pulse signal SP is inputted, and returns to an initial state every times when the start pulse signal SP are inputted four times.

In FIG. 5B, a configuration where a latch pulse signal is outputted every four counts is shown. However, when the numbers m, n of stages of the register circuits are altered, an interval during which the latch pulse signal is outputted can be varied. When the latch pulse generation circuit shown above is used, there is no necessity of inputting the latch pulse signal externally.

The latch pulse generation circuit according to the embodiment includes a first register circuit that counts a number of times by which the start pulse is inputted to determine a timing when a latch pulse is outputted, and a second register circuit that outputs a latch pulse every a definite cycle. FIG. 5A is only one example thereof and the circuit configuration is not restricted thereto.

Embodiment 3

Figure 6A:
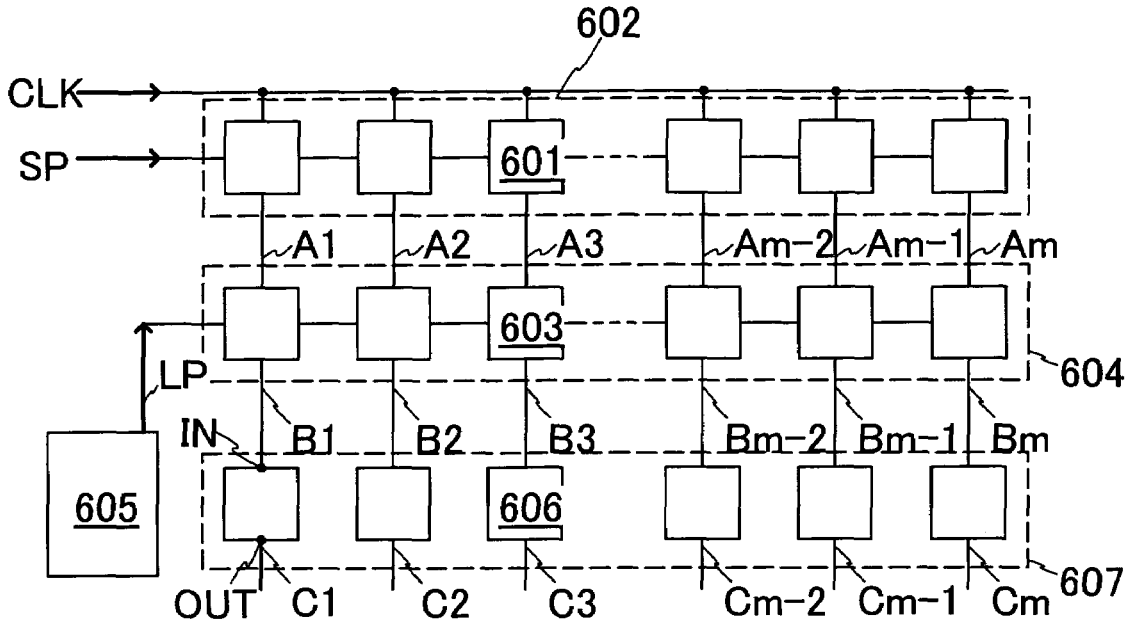
FIGS. 6A and 6B include diagrams each showing a circuit configuration of a semiconductor device according to embodiment 3 of the invention.

FIG. 6A is a diagram showing embodiment 3 according to the invention. The embodiment 3 includes a shift register circuit 602 that is constituted of register circuits 601, a latch circuit array 604 that is constituted of latch circuits 603, a current source circuit group 607 that is constituted of current source circuits 606, and a latch pulse generation circuit 605. The latch pulse generation circuit 605 may be formed on a substrate same as that on which the shift register circuit 602 and the latch circuit array 604 are formed or may be formed on a substrate different therefrom.

Operations of the shift register circuit and latch circuit array are identical as that of embodiment 1; accordingly, explanations thereof will be omitted.

Figure 6B:
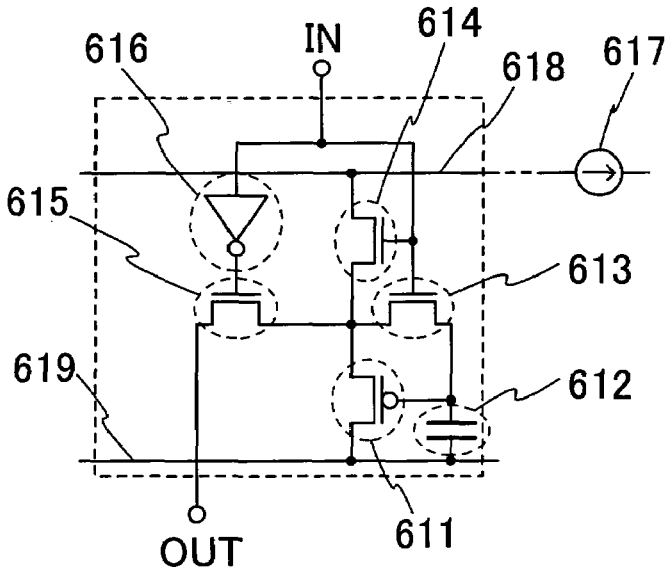

FIG. 6B is a diagram showing an example of current source circuits according to embodiment 3. The current source circuit includes a current driving transistor 611, a capacity element 612, a first switching transistor 613, a second switching transistor 614, a third switching transistor 615, an inverter 616, a reference current source 617, a current line 618, a power supply line 619, a control signal input terminal (represented as "IN" in the drawing) and a current output terminal (represented as "OUT" in the drawing).

To a gate terminal of the first switching transistor the control signal input terminal is connected, to a source terminal of the first switching transistor the current line is connected, to a drain terminal of the first switching transistor a drain terminal of the current driving transistor is connected, to a gate terminal of the second switching transistor the control signal input terminal is connected, to a source terminal of the second switching transistor a gate terminal of the current driving transistor is connected, to a drain terminal of the second switching transistor a drain terminal of the current driving transistor is connected, to a source terminal of the current driving transistor a power supply line is connected, between the gate terminal of the current driving transistor and the power supply line the capacity element is connected, to an input terminal of the inverter the control signal input terminal is connected, to an output terminal of the inverter a gate terminal of the third switching transistor is connected, to a drain terminal of the third switching transistor a drain terminal of the first switching transistor is connected, to a source terminal of the third switching transistor the current output terminal is connected and ahead of the current line the reference current source is connected.

In the next place, an operation of a current source circuit shown in FIG. 6B will be explained. When a signal having an H level is inputted in a control signal input terminal, a first switching transistor and a second switching transistor are turned on, and a third switching transistor, since a signal that is input in a gate terminal is reversed through an inverter and an L level is input, is turned off.

At this time, since the drain terminal and the gate terminal of the current driving transistor are in continuity, the current driving transistor operates in a saturation region, ahead of the current line, the reference current source is connected, a gate voltage of the current driving transistor varies so that a constant current may flow from the power supply line to a direction of the current line, and a potential difference between the source and gate of the current driving transistor is retained in a capacity element.

Subsequently, when a signal having an L level is input to a control signal input terminal, the first and second switching transistors are turned off and the third switching transistor is turned on. At this time, since the potential difference between the source and gate of the current driving transistor is retained at the capacity element, in the case of the current driving transistor being operated in a saturation region, a current same in the magnitude as that of the reference current is outputted from the current output terminal.

When a current source circuit shown in FIG. 6B is used in a current source circuit shown in FIG. 6A, an output from a latch circuit is connected to a control signal input terminal, an outputting stage can be selected arbitrarily every several stages and, at the same time, a pulse width of a control signal can be arbitrarily varied. Accordingly, in accordance with a time necessary for accumulating electric charges necessary for a capacity element, a pulse width has only to be controlled.

FIG. 6B is a diagram showing an example of current source circuits, and a current source circuit is not restricted to the configuration. For instance, a current mirror type current source circuit may be used.

Embodiment 4

Figure 7:
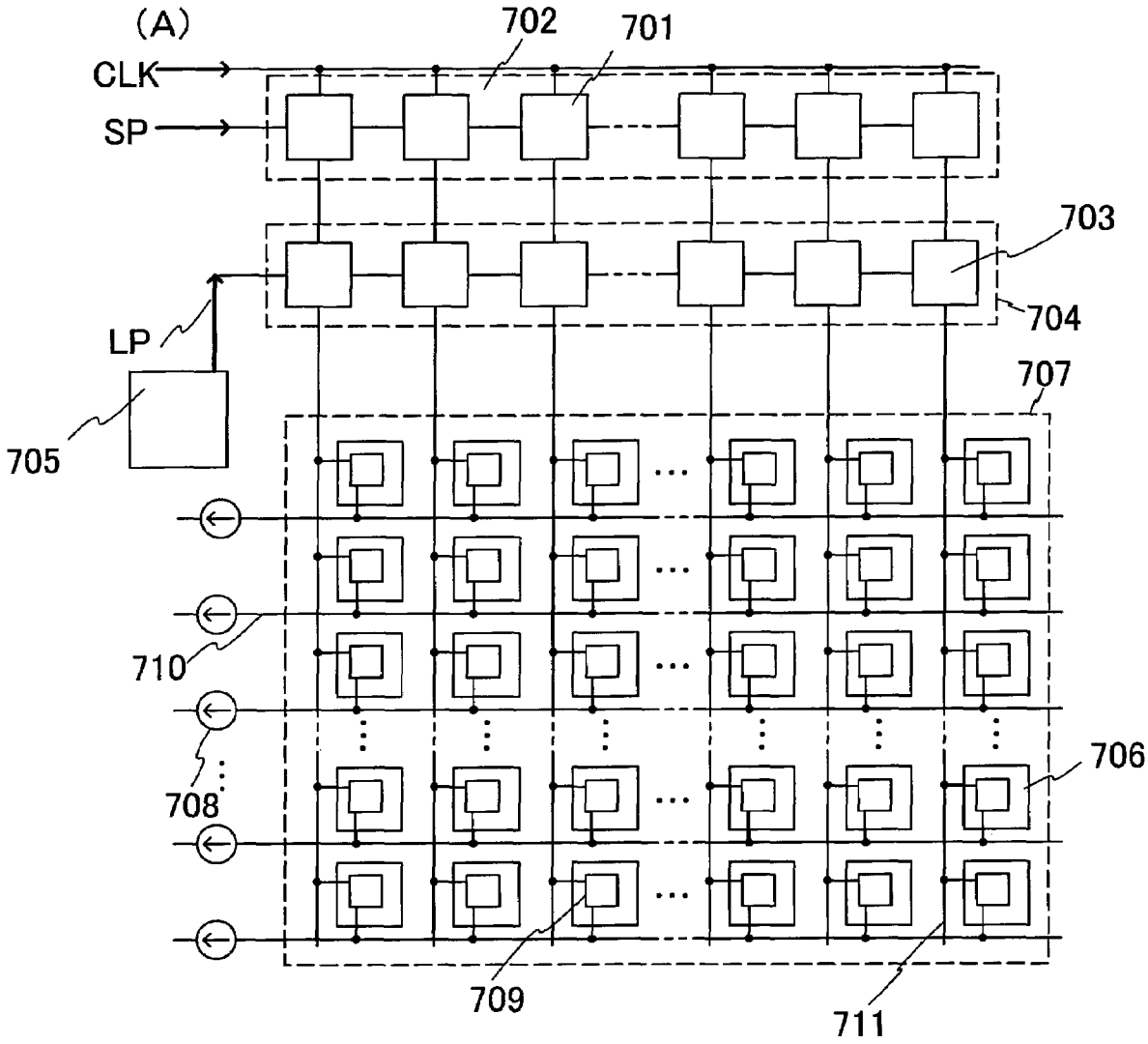
FIG. 7 is a diagram showing a circuit configuration of a semiconductor device according to embodiment 4 of the invention.

FIG. 7 is a diagram showing embodiment 4 according to the invention. The embodiment 4 includes a shift register circuit 702 that is structured of register circuits 701, a latch circuit array 704 that is structured of latch circuits 703, a pixel portion 707 that is structured of pixel circuits 706 having a current source circuit 709, a latch pulse generation circuit 705, reference current sources 708, current lines 710 and current source control signal lines 711. The latch pulse generation circuit 705 may be formed on a substrate same as that on which the shift register circuit 702 and the latch circuit array 704 are formed or may be formed on a substrate different therefrom. The current source control signal lines connected to output terminals of the latch circuits each are connected to the current source circuits in a plurality of pixel circuits. Furthermore, a plurality of the current lines connected to reference current source is disposed so as to intersect with interconnections of output of the latch circuits and each of the plurality of current lines is connected to the current source circuit in a plurality of pixel circuits.

Operations of the shift register circuit and latch circuit array are identical as that of embodiment 1; accordingly, explanations will be omitted.

Figure 8A:
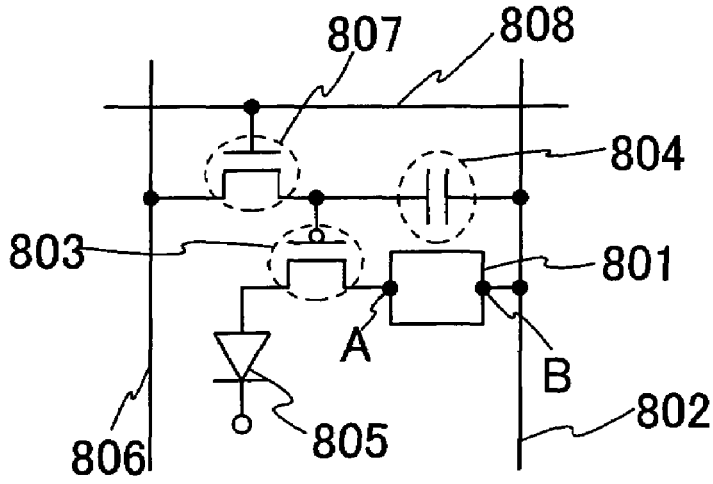
FIGS. 8A and 8B include diagrams each showing a circuit configuration of a pixel portion that can be used in a semiconductor device according to embodiment 4 of the invention.

FIG. 8A is a diagram showing an example of pixel circuits that can be used in the embodiment. Each of pixels includes a current source circuit 801, a power supply line 802, a light-emitting element driving transistor 803, a video signal holding capacity element 804, a light-emitting element 805, a source signal line 806, a switching transistor 807 and a gate signal line 808.

To a gate terminal of the switching transistor 807 the gate signal line 808 is connected, to one terminal of source and drain terminals of the switching transistor 808 a source signal line is connected, to the other terminal a gate terminal of the light-emitting element driving transistor 803 is connected, between the gate terminal of the light-emitting element driving transistor 803 and the power supply line 802 the video signal holding capacity element 804 is connected, to one terminal of the source and drain terminals of the light-emitting element driving transistor a light-emitting element is connected, and between the other terminal and the power supply line a current source circuit is connected.

An operation of a pixel circuit shown in FIG. 8A will be explained. When a signal having an H level is inputted to a gate signal line 808, a signal having an H level is inputted to a gate terminal of the switching transistor 807, and thereby the switching transistor 807 is turned on. At this time, a video signal is inputted from a source signal line, and a potential at that time is retained at the video signal retaining capacity element. Subsequently, a signal having an L level is inputted to the gate signal line 808, and thereby the switching transistor 808 is turned off. At this time, owing to a potential retained at the video signal holding capacity element, On or OFF of the light-emitting element driving transistor 803 is determined, thereby a current supply from the current source circuit to a light-emitting element is controlled, and thereby emission or non-emission is selected.

The pixel configuration shown in FIG. 8A is an example of pixels having a current source circuit in a pixel and a pixel configuration is not restricted to the configuration. As a pixel configuration according to the embodiment, as far as it has a current source circuit in a pixel, any configurations can be used.

Figure 8B:
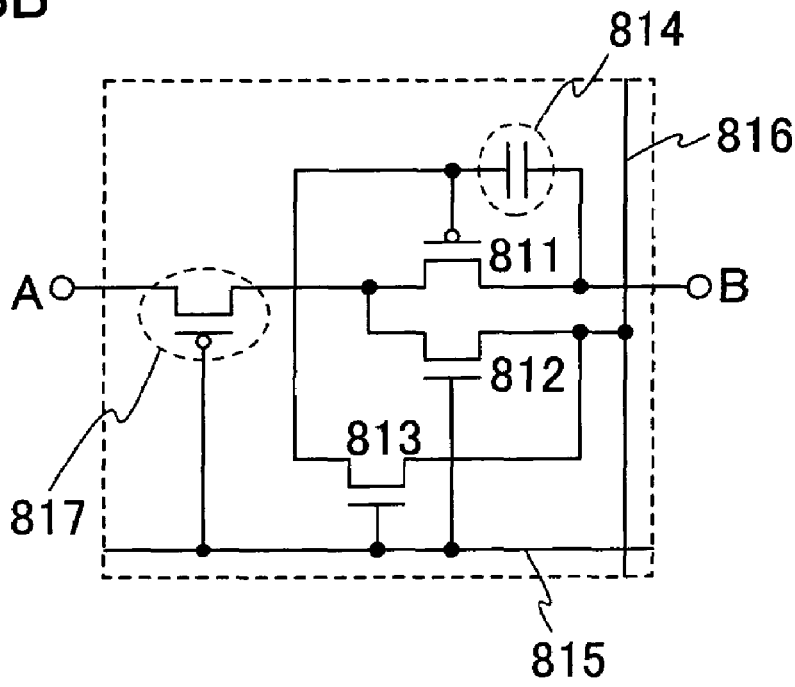
Figure 9A:
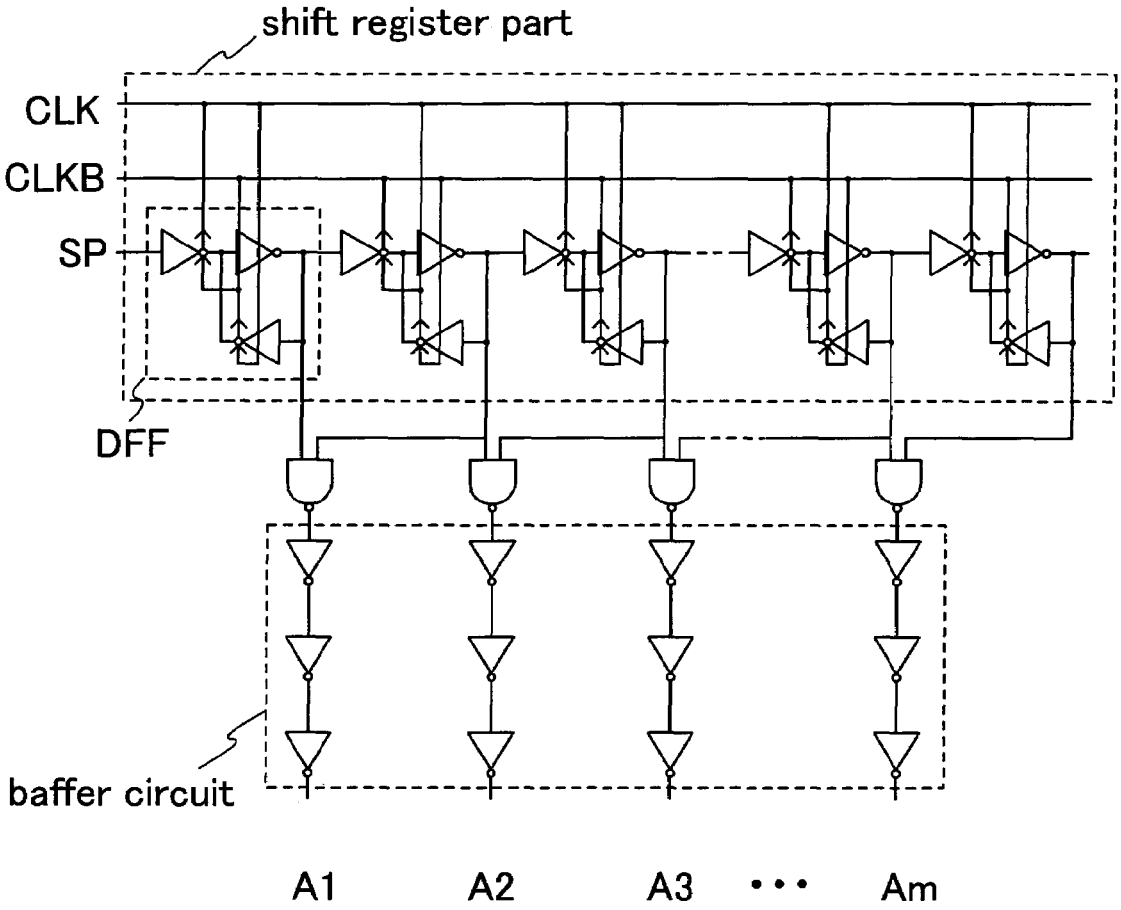
FIGS. 9A and 9B include a diagram showing a configuration and a diagram showing a timing chart according to an existing technology.
Figure 9B:
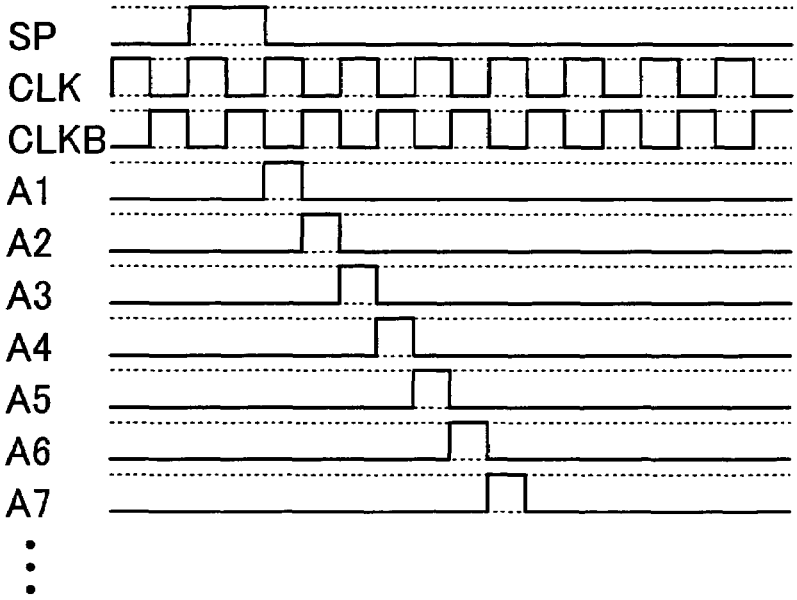

Furthermore, in FIG. 8B, an example of current source circuits when the pixel configuration is one shown in FIG. 8A is shown. The current source circuit includes a current driving transistor 811, a first switching transistor 812, a second switching transistor 813, a current source capacity element 814, a current source control signal line 815, a current line 816, a third switching transistor 817, a terminal A and a terminal B.

To each of gate terminals of the first switching transistor 812, the second switching transistor 813 and the third switching transistor 817, the current source control signal line 815 is connected, to one terminal of source and drain terminals of the first switching transistor 812 the current line 816 is connected, to the other terminal thereof one terminal of source and drain terminals of the third switching transistor 817 is connected, to the other terminal the terminal A is connected, to one terminal of source and drain terminals of the second switching terminal the current line 816 is connected, to the other terminal thereof a gate terminal of the current driving transistor 811 is connected, to one terminal of source and drain terminals of the current driving transistor the terminal B is connected, to the other terminal thereof a connection portion of one of source and drain terminals of the first switching transistor 812 and one of source and drain terminals of the third switching transistor is connected, and between the gate terminal of the current driving transistor 811 and the terminal B the current source capacity element is connected.

To the terminal B the current supply line is connected and to the terminal A a light-emitting element is connected through the light-emitting element driving transistor. An operation of the current source circuit, though a little different in connection relationship and configuration, is similar to that explained in embodiment 3 and will be omitted from explaining here.

FIG. 8B is a diagram showing an example of current source circuits that can be used in the embodiment, and any configuration of current source circuit may be used. For instance, connection relationship may be different and a current mirror type current source circuit may be used.

Furthermore, a level shift circuit that alters a voltage of an output signal from a latch circuit and a buffer circuit that increases driving capacity may be inserted between the latch circuit and the pixel circuit.

EXAMPLES

In what follows, examples according to the present invention will be explained with reference to the drawings.

Example 1

Figure 10:
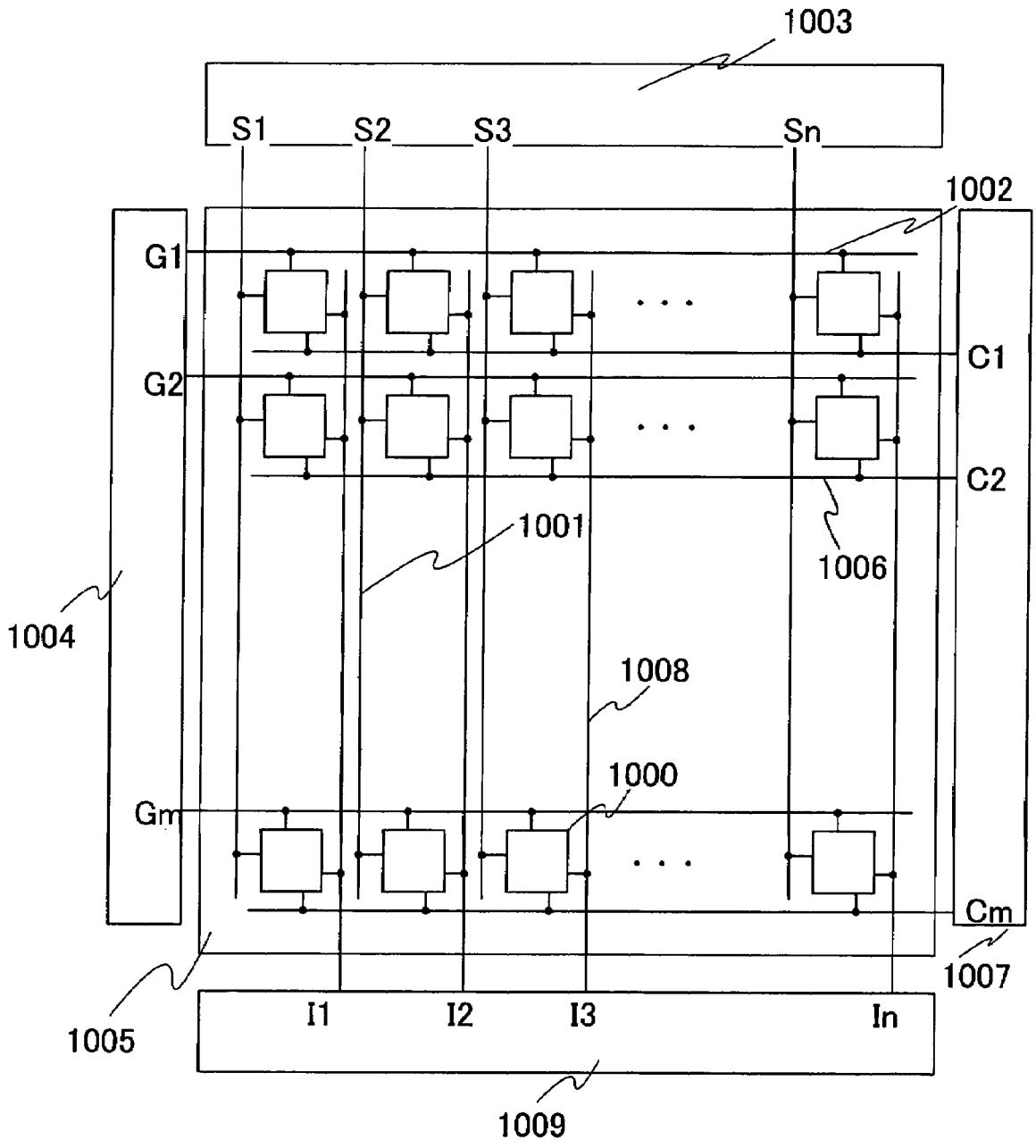
FIG. 10 is a diagram showing example 1 according to the invention.

In FIG. 10, example 1 according to the invention is shown. In the example, a configuration of a display device that uses a semiconductor device shown in embodiment will be explained. The display device includes a display portion 1005 in which a plurality of pixels 1000 is arranged in a matrix of m columns by n rows, and, in the surroundings of the display portion 1005, a source signal line driving circuit 1003, a write-in gate signal line driving circuit 1004, a current source control gate signal line driving circuit 1007 and a current output driving circuit. Source signal lines 1001 expressed with S1~Sn and current lines 1008 expressed with I1~In are connected to the pixels 1000 corresponding to rows, and both write-in gate signal lines expressed with G1~Gm and current source control gate signal lines 1006 expressed with C1~Cm are connected to the pixels 1000 corresponding to columns. In actuality, other than the above, power supply line and so on, though being connected to the pixels, are omitted here.

Here, in the current output driving circuit, the circuit configuration that was explained in embodiment 3 according to the invention is used, a constant current is supplied to the pixel, and in the current source control gate signal line driving circuit, the circuit configuration that was explained in embodiment 4 according to the invention may be used. Furthermore, in configurations of the source signal line driving circuit and the write-in gate signal line driving circuit, known ones may be used.

Figure 11:
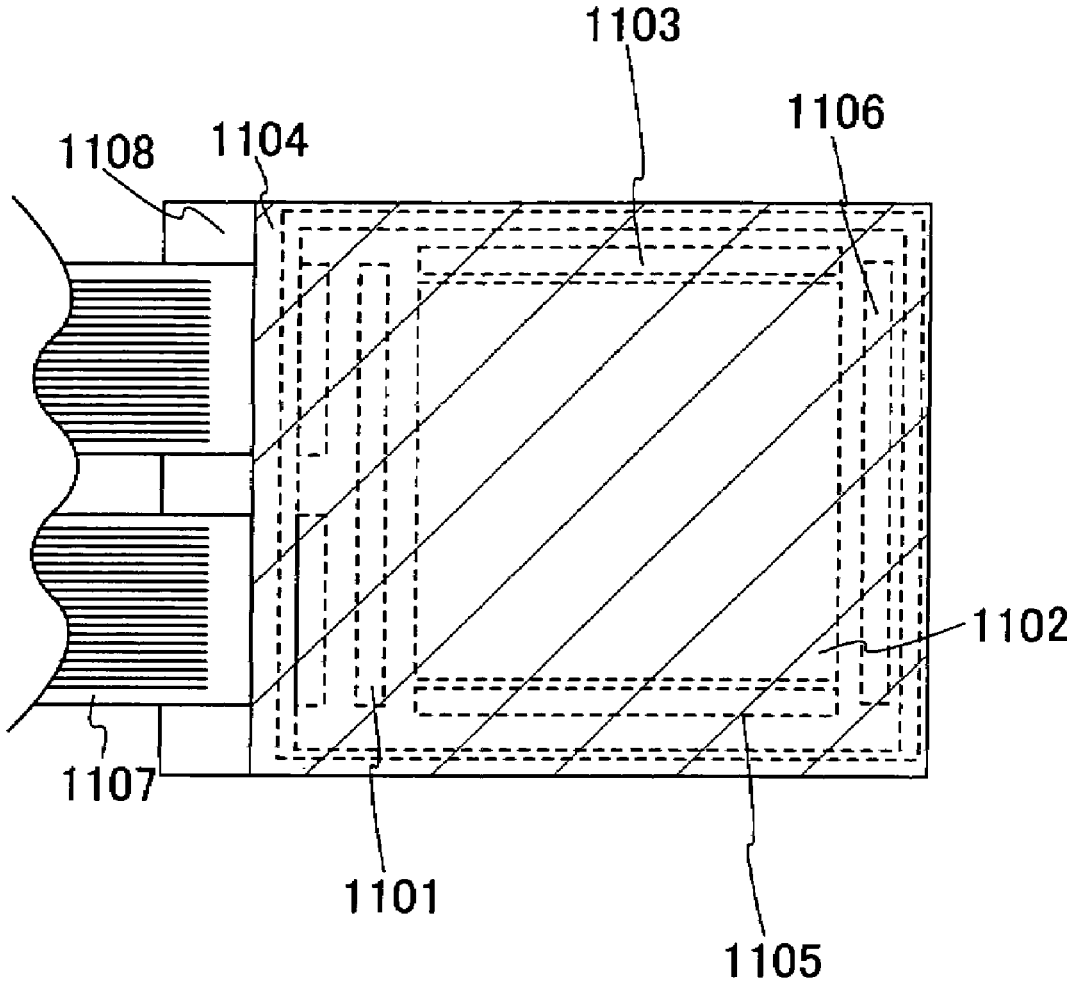
FIG. 11 is a diagram showing example 1 according to the invention.

In FIG. 11, an example where a module is formed with the above configurations is shown. On a TFT substrate 1108, a display portion where pixel circuits are arranged, a source signal line driving circuit 1101, a write-in gate signal line driving circuit 1103, a current control gate signal line driving circuit 1105 and a current output driving circuit are prepared, thereafter a light-emitting element and an opposite electrode are deposited, followed by sealing with an opposite substrate 1104. Thereafter, an FPC is stuck, a signal and a power source are externally supplied through the FPC, and thereby a driving circuit is operated to display an image.

Figure 12:
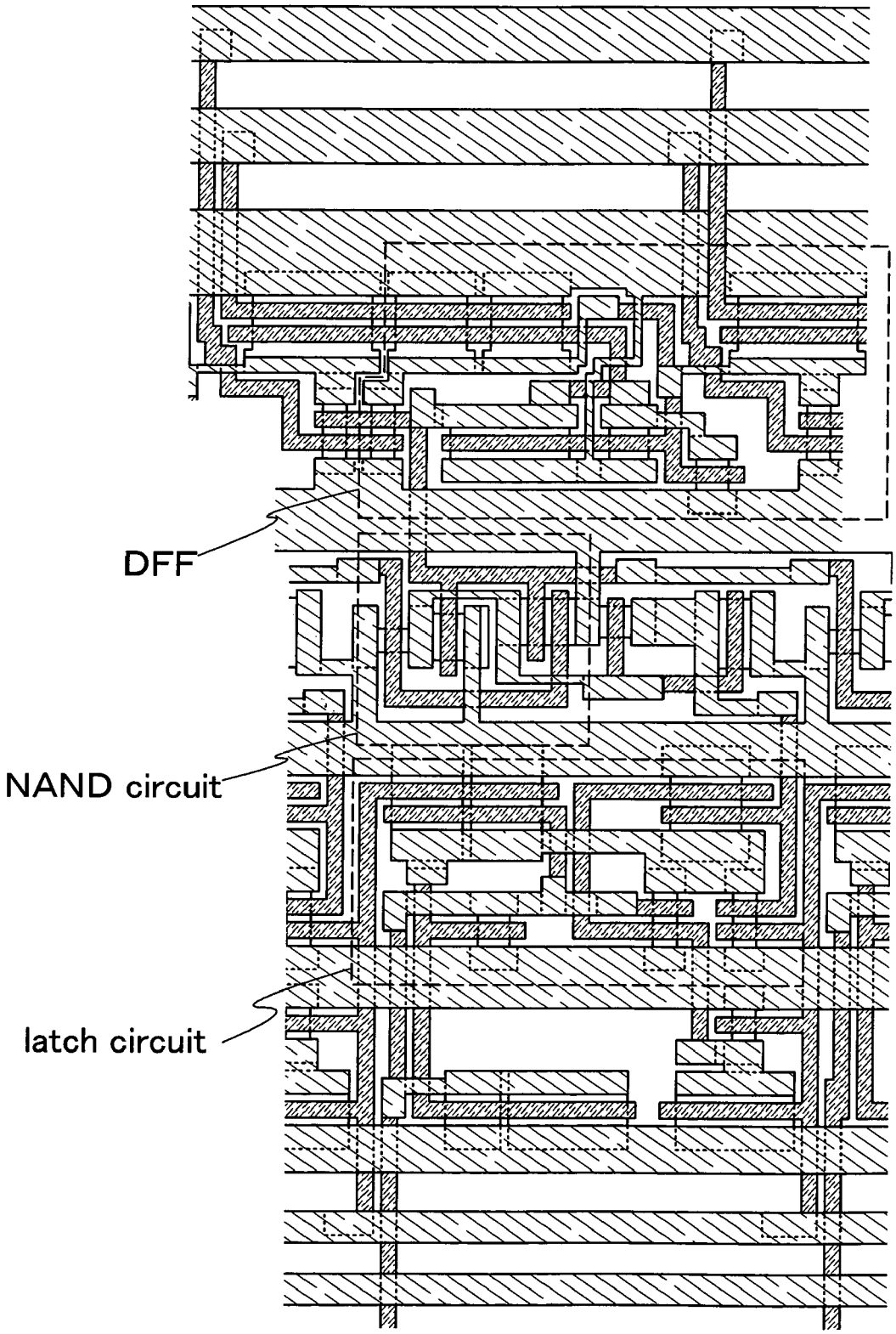
FIG. 12 is a diagram showing a top view of a driving circuit according to example 1 of the invention.
Figure 13A:
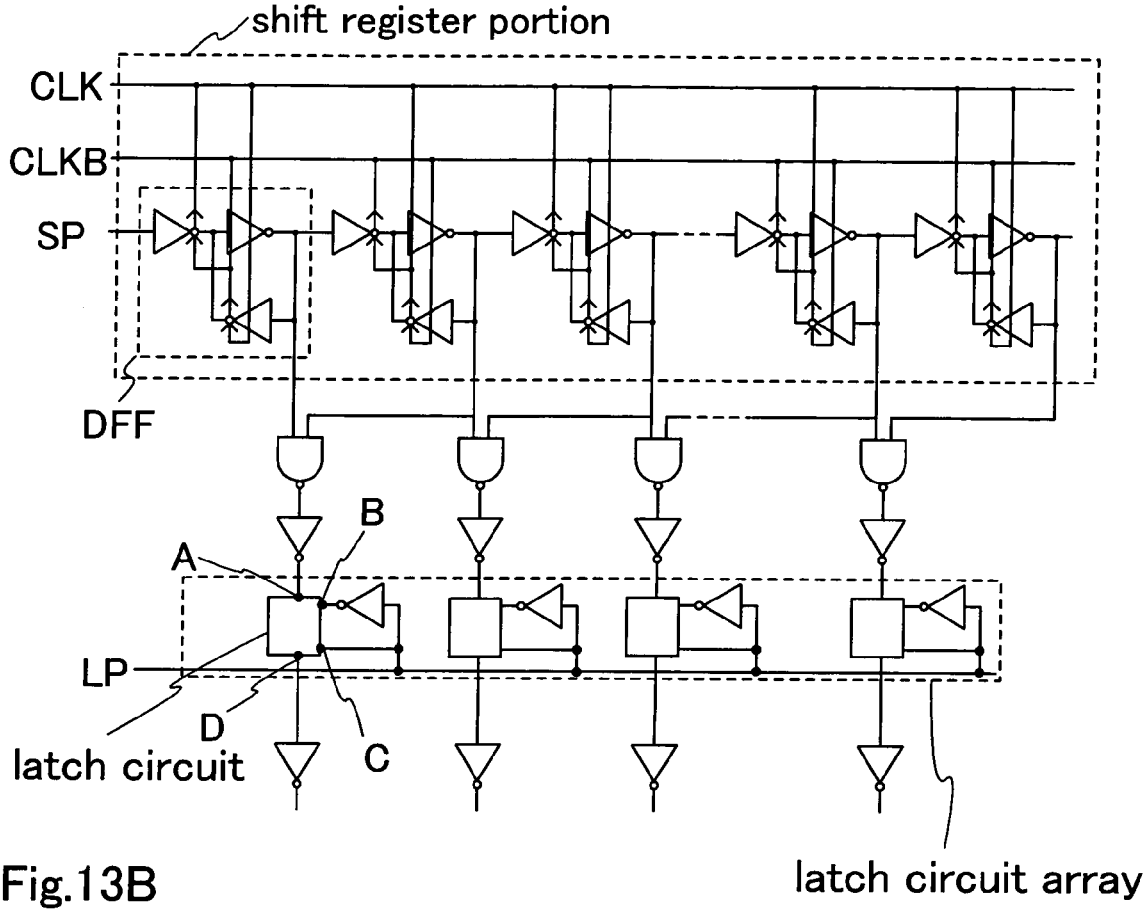
FIGS. 13A and 13B include diagrams showing equivalent circuits of top views of a driving circuit according to example 1 of the invention.
Figure 13B:
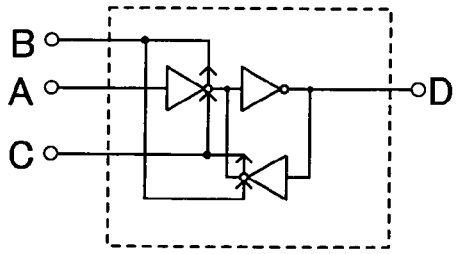

FIG. 12 shows a partial top view of the current source control gate signal line driving circuit according to example 1, and in FIG. 13A an equivalent circuit of the top view is shown. One stage portion of FIG. 13A corresponds to the top view. Furthermore, in FIG. 13B, a configuration of the latch circuit is shown.

Example 2

As electronics devices with a display device that uses a semiconductor device according to the invention, a video camera, a digital camera, a goggle type display device (head-mount display device), a navigation system, an audio player (car audio, audio compo and so on), a note type personal computer, a game machine, a portable information terminal (mobile computer, portable telephone, portable game machine or electronic book), and an image player with a recording medium (specifically, a device provided with a display that can reproduce a recording medium such as a Digital Versatile Disc (DVD) and display an image thereof) can be cited. In particular, in the portable information terminals in which a screen is frequently viewed from an oblique direction, since a wide viewing angle is important, a self-emitting display device is desirably used.

Specific examples of electronic devices are shown in FIG. 14. The electronic devices shown in the present embodiment are only partial examples and the invention is not restricted to these applications.

Figure 14A:
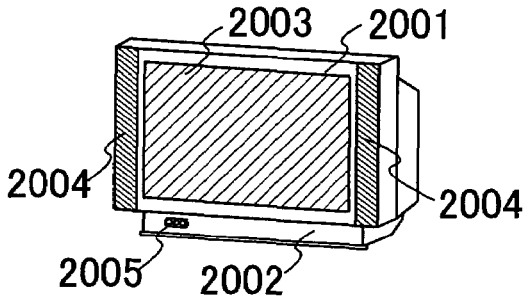
FIGS. 14A to 14H include diagrams showing examples of electronic devices to which the invention can be applied.

FIG. 14A is a diagram showing a display, the display including a casing 2001, a support table 2002, a display portion 2003, a speaker part 2004, a video input terminal 2005 and so on. A display device that uses a semiconductor device according to the invention can be used in the display portion 2003. Furthermore, according to the invention, a display shown in FIG. 14A can be completed. Since a display device that uses a semiconductor device according to the invention is a self-emitting one and a backlight is not necessary, the display portion can be made thinner than a liquid crystal display device. The display includes all display devices for use in information display such as a personal computer, a TV broadcasting receiver, and a billboard display.

Figure 14B:
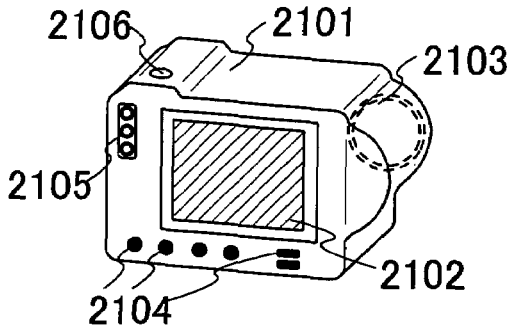

FIG. 14B is a diagram showing a digital still camera, the digital still camera including a body 2101, a display part 2102, a receiver 2103, an operation key 2104, an external connection port 2105, and a shutter 2106. A display device that uses a semiconductor device according to the invention can be used in the display part 2102. Furthermore, according to the invention, a digital still camera shown in FIG. 14B can be completed.

Figure 14C:
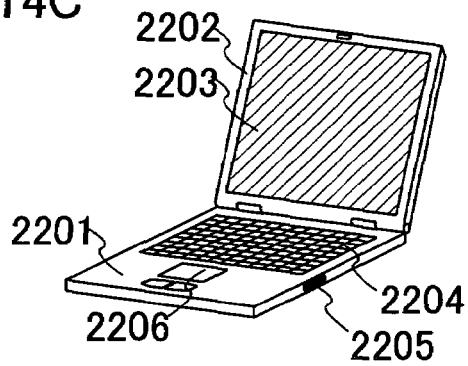

FIG. 14C is a diagram showing a note type personal computer, the personal computer including a body 2201, a casing 2202, a display portion 2203, a key board 2204, an external connection port 2205 and a pointing mouth 2206. A display device that uses a semiconductor device according to the invention can be used in the display part 2203. Furthermore, according to the invention, a note type personal computer shown in FIG. 14C can be completed.

Figure 14D:
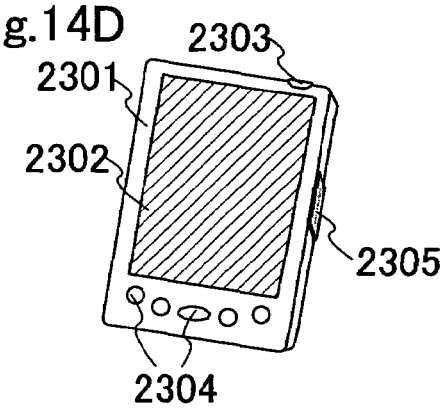

FIG. 14D is a diagram showing a mobile computer, the mobile computer including a body 2301, a display portion 2302, a switch 2303, an operation key 2304 and an IR port 2305. A display device that uses a semiconductor device according to the invention can be used in the display part 2302. Furthermore, according to the invention, a mobile computer shown in FIG. 14D can be completed.

Figure 14E:
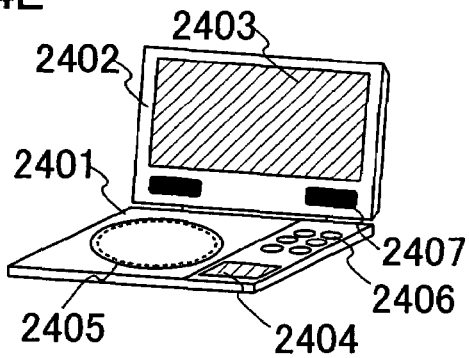

FIG. 14E is a diagram showing a portable image player with a recording medium (specifically a DVD player), the image player including a body 2401, a casing 2402, a display portion A 2403, a display portion B 2404, a recording medium (DVD and so on) read part 2405, an operation key 2406, and a speaker 2407. The display portion A 2403 primarily displays image information and the display portion B 2404 primarily display textual information. A display device that uses a semiconductor device according to the invention can be used in these display portions A 2403, B 2404. A home game machine is also included in the image player with a recording medium. Furthermore, according to the invention, a DVD player shown in FIG. 14E can be completed.

Figure 14F:
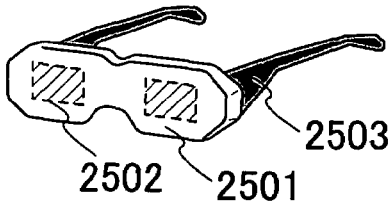

FIG. 14F is a diagram showing a goggle type display (head-mount display), the display including a body 2501, a display portion 2502, and an arm portion 2503. A display device that uses a semiconductor device according to the invention can be used in the display part 2502. Furthermore, according to the invention, a goggle type display shown in FIG. 14F can be completed.

Figure 14G:
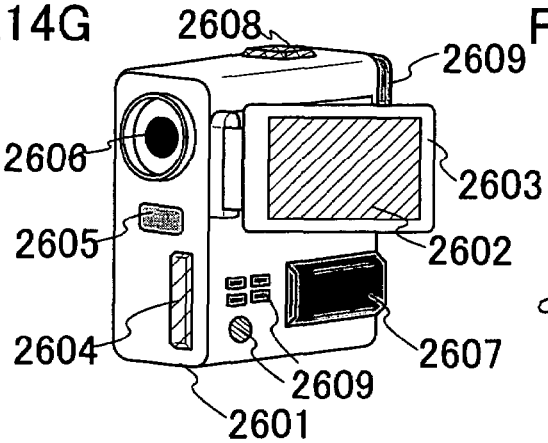

FIG. 14G is a diagram showing a video camera, the video camera including a body 2601, a display portion 2602, a casing 2603, an external connection port 2604, a remote control receiver 2605, an image receiver 2606, a battery 2607, an audio input portion 2608 and an operation key 2609. A display device that uses a semiconductor device according to the invention can be used in the display part 2602. Furthermore, according to the invention, a video camera shown in FIG. 14G can be completed.

Figure 14H:
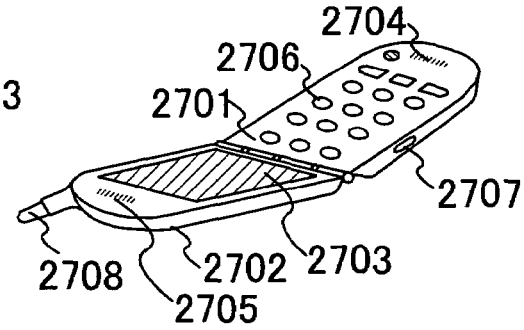

FIG. 14H is a diagram showing a portable telephone, the portable telephone including a body 2701, a casing 2702, a display portion 2703, an audio input portion 2704, an audio output portion 2705, an operation key 2706, an external connection port 2707, and an antenna 2708. A display device that uses a semiconductor device according to the invention can be used in the display part 703. When the display portion 2703 displays white characters on a black background, a consumption current of the portable telephone can be suppressed low. Furthermore, according to the invention, a portable telephone shown in FIG. 14H can be completed.

In future, when emission brightness of light-emitting materials becomes higher, light including outputted image information, by projecting enlarged by use of a lens and so on, can be used in a front type or rear type projector.

Furthermore, the electronic devices are becoming frequent in displaying information delivered through electronic communication lines such as INTERNET and CATV (cable TV), in particular, chances of displaying dynamic images are increasing. Since light-emitting materials are very high in the response speed, the display devices that use a semiconductor device according to the invention can be preferably used in displaying dynamic images.

Still furthermore, the display device that uses a semiconductor device according to the invention consumes electric power in an emitting portion; accordingly, it is desirable to display information so that an emitting portion may be as small as possible. Accordingly, in the case of the display device being used in a display portion that mainly displays textural information such as portable information terminals, in particular, portable telephones and audio players, it is desirably driven so that the textural information may be formed with light-emitting portions with non-emitting portions as a background.

INDUSTRIAL APPLICABILITY

As described above, an application range of the present invention is very wide and the invention can be applied to all fields of electronic devices. Furthermore, the electronic device according to example 2 can use a configuration shown in example 1.

The invention claimed is:

1. A semiconductor device comprising:
a shift register having a register circuit;
a latch circuit array having a latch circuit; and
a circuit which generates a latch pulse for driving the latch circuit,
wherein a start pulse is inputted to the shift register,
wherein the start pulse is sequentially shifted to the register circuit in accordance with a clock signal,
wherein the latch circuit starts outputting a pulse to a current source circuit when a pulse outputted from the register circuit and a latch pulse outputted from the circuit which generates the latch pulse are inputted to the latch circuit, and
wherein a pulse width of the pulse outputted from the latch circuit is controlled by an interval of the latch pulse.

2. A semiconductor device according to claim 1, wherein the circuit which generates the latch pulse is formed on the same substrate as the shift register and the latch circuit array.

3. A semiconductor device according to claim 1, wherein the circuit which generates the latch pulse generates the latch pulse from the start pulse and the clock signal.

4. A semiconductor device according to claim 1, wherein the circuit which generates the latch pulse comprises a first shift register circuit comprising a first register circuit which shifts in synchronization with the start pulse, and a second shift register circuit comprising a second register circuit which shifts in synchronization with the clock signal.

5. A semiconductor device according to claim 1, wherein an output terminal of the latch circuit is connected to a control terminal of the current source circuit.

6. A semiconductor device according to claim 1, wherein the current source circuit is formed in a driver circuit which controls a current value inputted to a pixel.

7. A semiconductor device according to claim 1, wherein the current source circuit is formed in plural pixels arranged in a matrix shape.

8. A semiconductor device according to claim 1, wherein the semiconductor device is used for at least one electronic device selected from the group consisting of a video camera, a goggle type display device, a navigation system, an audio player, a note type personal computer, a game machine, a portable information terminal and an image player with a recording medium.

9. A driving method of a semiconductor device which comprises a shift register circuit having a register circuit, a latch circuit array having a latch circuit, a circuit which generates a latch pulse for driving the latch circuit, the method comprising:
inputting a start pulse to the shift register,
shifting the start pulse sequentially to the register circuit in accordance with a clock signal,
inputting a pulse outputted from the register circuit and a latch pulse outputted from the circuit which generates the latch pulse to the latch circuit to start outputting a pulse to a current source circuit, and
controlling a pulse width of the pulse outputted from the latch circuit by an interval of the latch pulse.

10. A driving method of a semiconductor device according to claim 9, wherein the circuit which generates the latch pulse is formed on the same substrate as the shift register and the latch circuit array.

11. A driving method of a semiconductor device according to claim 9, wherein the circuit which generates the latch pulse generates the latch pulse from the start pulse and the clock signal.

12. A driving method of a semiconductor device according to claim 9, wherein the circuit which generates the latch pulse comprises a first shift register circuit comprising a first register circuit which shifts in synchronization with the start pulse, and a second shift register circuit comprising a second register circuit which shifts in synchronization with the clock signal.

13. A driving method of a semiconductor device according to claim 9, wherein an output terminal of the latch circuit is connected to a control terminal of the current source circuit.

14. A driving method of a semiconductor device according to claim 9, wherein the current source circuit is formed in a driver circuit which controls a current value inputted to a pixel.

15. A driving method of a semiconductor device according to claim 9, wherein the current source circuit is formed in plural pixels arranged in a matrix shape.

16. A driving method of a semiconductor device according to claim 9, wherein the semiconductor device is used for at least one electronic device selected from the group consisting of a video camera, a goggle type display device, a navigation system, an audio player, a note type personal computer, a game machine, a portable information terminal and an image player with a recording medium.

17. A light-emitting display device comprising:
a shift register having a register circuit;
a latch circuit array having a latch circuit; and
a circuit which generates a latch pulse for driving the latch circuit,
wherein a start pulse is inputted to the shift register,
wherein the start pulse is sequentially shifted to the register circuit in accordance with a clock signal,
wherein the latch circuit starts outputting a pulse to a current source circuit when a pulse outputted from the register circuit and a latch pulse outputted from the circuit which generates the latch pulse are inputted to the latch circuit, and wherein a pulse width of the pulse outputted from the latch circuit is controlled by an interval of the latch pulse.

18. A light-emitting display device according to claim 17, wherein the circuit which generates the latch pulse is formed on the same substrate as the shift register and the latch circuit array.

19. A light-emitting display device according to claim 17, wherein the circuit which generates the latch pulse generates the latch pulse from the start pulse and the clock signal.

20. A light-emitting display device according to claim 17, wherein the circuit which generates the latch pulse comprises a first shift register circuit comprising a first register circuit which shifts in synchronization with the start pulse, and a second shift register circuit comprising a second register circuit which shifts in synchronization with the clock signal.

21. A light-emitting display device according to claim 17, wherein an output terminal of the latch circuit is connected to a control terminal of the current source circuit.

22. A light-emitting display device according to claim 17, wherein the current source circuit is formed in a driver circuit which controls a current value inputted to a pixel.

23. A light-emitting display device according to claim 17, wherein the current source circuit is formed in plural pixels arranged in a matrix shape.

24. A light-emitting display device according to claim 17, wherein the light-emitting display device is used for at least one electronic device selected from the group consisting of a video camera, a goggle type display device, a navigation system, an audio player, a note type personal computer, a game machine, a portable information terminal and an image player with a recording medium.

25. A driving method of a light-emitting display device which comprises a shift register circuit having a register circuit, a latch circuit array having a latch circuit, a circuit which generates a latch pulse for driving the latch circuit, the method comprising:

inputting a start pulse to the shift register, shifting the start pulse is sequentially to the register circuit in accordance with a clock signal, inputting a pulse outputted from the register circuit and a latch pulse outputted from the circuit which generates the latch pulse to the latch circuit to start outputting a pulse to a current source circuit, and controlling a pulse width of the pulse outputted from the latch circuit by an interval of the latch pulse.

26. A driving method of a light-emitting display device according to claim 25, wherein the circuit which generates the latch pulse is formed on the same substrate as the shift register and the latch circuit array.

27. A driving method of a light-emitting display device according to claim 25, wherein the circuit which generates the latch pulse generates the latch pulse from the start pulse and the clock signal.

28. A driving method of a light-emitting display device according to claim 25, wherein the circuit which generates the latch pulse comprises a first shift register circuit comprising a first register circuit which shifts in synchronization with the start pulse, and a second shift register circuit comprising a second register circuit which shifts in synchronization with the clock signal.

29. A driving method of a light-emitting display device according to claim 25, wherein an output terminal of the latch circuit is connected to a control terminal of the current source circuit.

30. A driving method of a light-emitting display device according to claim 25, wherein the current source circuit is formed in a driver circuit which controls a current value inputted to a pixel.

31. A driving method of a light-emitting display device according to claim 25, wherein the current source circuit is formed in plural pixels arranged in a matrix shape.

32. A driving method of a light-emitting display device according to claim 25, wherein the light-emitting display device is used for at least one electronic device selected from the group consisting of a video camera, a goggle type display device, a navigation system, an audio player, a note type personal computer, a game machine, a portable information terminal and an image player with a recording medium.

* * * * *